US010615519B2

(12) United States Patent
Koellmann et al.

(10) Patent No.: US 10,615,519 B2
(45) Date of Patent: Apr. 7, 2020

(54) CONNECTION TERMINAL

(71) Applicant: WAGO Verwaltungsgesellschaft mbH, Minden (DE)

(72) Inventors: Hans-Josef Koellmann, Minden (DE); Frank Hartmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/673,019

(22) Filed: Nov. 4, 2019

(65) Prior Publication Data

US 2020/0067212 A1 Feb. 27, 2020

Related U.S. Application Data

(63) Continuation of application No. PCT/EP2018/060594, filed on Apr. 25, 2018.

(30) Foreign Application Priority Data

May 5, 2017 (DE) ..... 10 2017 109 694

(51) Int. Cl.
*H01R 4/26* (2006.01)
*H01R 4/48* (2006.01)
(Continued)

(52) U.S. Cl.
CPC ..... *H01R 4/4836* (2013.01); *H01R 4/4845* (2013.01); *H01R 9/223* (2013.01); *H01R 9/2408* (2013.01)

(58) Field of Classification Search
CPC .... H01R 4/4836; H01R 4/4845; H01R 9/223; H01R 9/2408; H01R 13/42; H01R 13/4223
(Continued)

(56) References Cited

U.S. PATENT DOCUMENTS 6,146,187 A 11/2000 Pallai
6,250,950 B1 6/2001 Pallai
(Continued)

FOREIGN PATENT DOCUMENTS

DE 2062158 A1 7/1972
DE 3418536 A1 11/1985
(Continued)

OTHER PUBLICATIONS

International Search Report dated Sep. 21, 2018 in corresponding application PCT/EP2018/060594.
(Continued)

*Primary Examiner* — Khiem M Nguyen
(74) *Attorney, Agent, or Firm* — Muncy, Geissler, Olds & Lowe, P.C.

(57) ABSTRACT

A connecting terminal having an insulating housing, a conductor insertion channel extending toward a conductor insertion axis with an at least partially circumferential conductor channel wall arranged coaxially to the conductor insertion axis, and an actuation channel disposed adjacent to the conductor insertion channel. A leg spring bent in a U-shape has a contact leg, a clamping leg and a spring bow. A push button is adapted to be received in the actuation channel in a longitudinally displaceable manner. The contact leg is mounted on the bus bar, and a clamping edge of the clamping leg forms a spring clamp connection with a contact region of the bus bar for clamping an electrical conductor inserted in the conductor insertion channel. An actuation axis defined by a displacement direction of the push button and the conductor insertion axis are aligned with each other at an angle of 5° to 30°.

21 Claims, 12 Drawing Sheets

(51) Int. Cl.
*H01R 9/24* (2006.01)
*H01R 9/22* (2006.01)

(58) Field of Classification Search
USPC ..... 439/441, 535, 729
See application file for complete search history.

(56) References Cited

U.S. PATENT DOCUMENTS

| | | | | |
|---|---|---|---|---|
| 6,851,967 | B2 | 2/2005 | Miyoshi et al. | |
| 8,262,405 | B1 * | 9/2012 | Bishop | H01R 4/4845 439/439 |
| 9,614,301 | B2 | 4/2017 | Ludewig et al. | |
| 9,847,587 | B2 | 12/2017 | Ludewig et al. | |
| 10,418,727 | B1 * | 9/2019 | Wu | H01R 4/4836 |
| 2009/0264027 | A1 | 10/2009 | Ruiz | |
| 2018/0358715 | A1 * | 12/2018 | Geske | H01R 4/4836 |

FOREIGN PATENT DOCUMENTS

| | | | |
|---|---|---|---|
| DE | 19982799 | T1 | 3/2001 |
| DE | 60128235 | T2 | 12/2007 |
| DE | 102008062137 | A1 | 6/2010 |
| DE | 102010015457 | A1 | 10/2011 |
| DE | 2013111574 | A1 | 4/2015 |
| DE | 102015120063 | B3 | 1/2017 |
| EP | 3159971 | A1 | 4/2017 |

OTHER PUBLICATIONS

International Preliminary Report on Patentability dated Nov. 5, 2019 in corresponding application PCT/EP2018/060594.

* cited by examiner

CONNECTION TERMINAL

This nonprovisional application is a continuation of International Application No. PCT/EP2018/060594, which was filed on Apr. 25, 2018, and which claims priority to German Patent Application No. 10 2017 109 694.9, which was filed in Germany on May 5, 2017, and which are both herein incorporated by reference.

BACKGROUND OF THE INVENTION

Field of the Invention

The present invention relates to a connecting terminal.

Description of the Background Art

DE 10 2013 111 574 A1, which corresponds to U.S. Pat. No. 9,614,301, which is incorporated herein by reference, shows a spring clamp connection for clamping electrical conductors with a push button that is displaceably received in the insulating housing. The push button has an actuation surface for engagement with the clamping leg of the clamping spring, such that the push button is guided along the clamping leg. A projecting lug of the push button sticks out into the mouth of the conductor insertion opening and forms part of the wall of the conductor insertion opening.

DE 10 2015 120 063 B3, which is incorporated herein by reference, shows a conductor terminal with an insulating housing and a spring clamp connection and a push button received to be displaceable in a push button shaft. The push button has a projecting push button lug, which in the state of actuation ends above a conductor receiving opening introduced into a bus bar. The push button is displaceably mounted on the boundary wall of the conductor insertion opening defining the conductor insertion direction, in parallel with said conductor insertion direction.

The insulating housing and push button of conventional connecting terminals may be made of plastic material. The forces acting on the push button and also the insulating housing can cause the plastic material to deform. This is especially true because the space available in the area of the clamping spring for accommodating the conductor insertion opening and the push button next to the clamping spring, and thus the available material thickness, is very limited.

SUMMARY OF THE INVENTION

It is therefore an object of the present invention to provide an improved connecting terminal.

In an exemplary embodiment, a connecting terminal is provided having an insulating housing, comprising a conductor insertion channel extending toward a conductor insertion axis with an at least partially circumferential conductor channel wall arranged coaxially to the conductor insertion axis, and an actuation channel disposed next to the conductor insertion channel, a leg spring bent in a U-shape having a contact leg, a clamping leg and a spring bow connecting the contact leg to the clamping leg, a bus bar and a push button received in the actuation channel in a longitudinally displaceable manner. Whereby the contact leg is mounted on the bus bar and a clamping edge of the clamping leg forms a spring clamp connection with a contact region of the bus bar for clamping an electrical conductor inserted in the conductor insertion channel.

"Coaxial" is not only meant to be the arrangement in reference to a cylindrical conductor channel wall. When the center of gravity of a constant cross section of the conductor channel wall in the extension direction runs parallel to the conductor insertion axis, then it is also coaxial.

By virtue of the orientation of the actuation axis, which is defined by the longitudinal displacement direction of the push button in the actuation channel, relative to the conductor insertion axis at an angle of 5° to 30° and preferably 5° to 20°, it is ensured that the conductor insertion opening and the push button can be received in a very small space. The inserted conductor and the push button are thereby displaced toward one another to a common (virtual) meeting point into the insulating housing when they are at such an acute angle to one another. The angular offset allows for the space between the actuation channel and the conductor insertion channel thus made available to be used to optimize the support for the push button. Due to the relative angular offset between the extension direction of the conductor insertion channel and the extension direction of the actuation channel, the direction of force acting on the push button by the clamping leg of the clamping spring can be improved in order to prevent the push button and thus also the insulating housing from deforming.

With a structurally adapted nozzle, the angle can in particular be formed larger while being in the angular range of more than 20° specified above. Comparable structural designs are conceivable in order to obtain the desired angular orientation.

The conductor channel wall may form a dividing wall to the actuation channel. The push button is then guided in a section of the dividing wall which conically tapers the conductor insertion channel. This section can be oriented in parallel with the actuation axis.

The actuation axis can be approximately perpendicular to the plane spanned by the connection opening. "Approximately perpendicular" can be understood to mean in particular an angle of 90° with a tolerance of ±several degrees, for example, ±5° and preferably ±2°.

This conically tapering section is not only used in this way for the targeted guidance of a stripped end of an electrical conductor to be clamped to the clamping point, but also provides a support wall for the push button in the area located close to the clamping spring. Under the influence of the deflected clamping spring, the force components acting via the push button on the conically rejuvenating section of the dividing wall act at a more acute angle than if the push button were to be supported on a non-conically tapering section of the dividing wall of the conductor insertion channel. In this way, the risk of plastic or elastic deformation to the dividing wall can be reduced.

The bus bar can have a connection opening, wherein the leg spring is inserted into this connection opening. In the state of actuation, in which the clamping leg is displaced by the push button toward the contact leg, the push button then projects out into this connection opening.

With such a connection opening, which may also be designed like a channel in the manner of a material passage with guide walls, an electrical conductor can be reliably guided to the clamping point. This is especially true for stranded electrical conductors whose strands can otherwise spread open when the conductor is clamped with the aid of the push button without previously deflecting the clamping spring. In such a connection opening, the available space for receiving the electrical conductor and the clamping spring is greatly reduced. Optimal utilization of the available small space succeeds without risk of deformation by orientating the actuation axis and the conductor insertion axis at an angle of 5° to 20° to each other. The interaction of the push button and the clamping spring is significantly improved if the displacement of the push button is taken advantage of as much as possible towards the clamping end of the clamping leg. This succeeds if the push button dips into the connection opening in the state of actuation. Thereby, the available space is further restricted. In fact, however, this displacement is available when the actuation axis and the conductor insertion axis are oriented towards each other at an angle of 5° to 20°. This way, the electrical conductor is advantageously guided along the push button and does not encounter the clamping leg.

At its actuation end acting on the clamping leg, the push button can have a shoulder which reduces the width of the actuation end. The shoulder then forms a stop for resting on a peripheral region of the bus bar which delimits the connection opening. Due to the fact that the actuation end of the push button tapers off in order to dip into the connection opening, the displacement path of the push button is delimited by means of the shoulder, which forms a stop between the push button and the bus bar. In addition, by means of the shoulder, the push button is formed wider above the actuation end than within the actuation end. This way, the push button is more stable and can be supported at the widened end of the insulating housing in an area that, due to the cylindrical design of the adjacent conductor insertion channel, is stronger than in the central section.

The surface of the push button which faces towards the clamping leg can be formed from the actuation head to the clamping leg without a projection. In other words, the push button is formed free of projections toward the clamping leg, in cross section perpendicular to the actuation axis when viewed starting from an actuation head in the direction from the conductor insertion channel to the clamping spring. If the actuation end thus has a cross section which is constant in the direction of the clamping leg or in the opposite direction towards the mouth of the conductor insertion channel, i.e., which has no projection, then possible bending moments are avoided or at least reduced, which can act on the push button by the clamping spring. In addition, the space required by the push button is kept to a minimum with the projection-free design.

The end face of the actuation end of the push button acting on the clamping leg may have a rounded contour. In that case, the actuation end tapers, but because of the rounded contour, no adverse projection is formed.

In a head section, which is located next to a cylindrical sheath receiving section of the conductor insertion channel, the actuation channel can be conically widened toward the outside of the insulating housing. Thus, the push button has an actuation head in the conically widened head section, which viewed from the conductor insertion channel to the clamping spring increases in thickness towards the outer side of the insulating housing. The space towards the outside which is increased due to the oblique position of the actuation axis and the conductor insertion axis, as compared to a parallel alignment, can be used to realize a widened actuation head. The actuation channel then has a cross section that is matched to the conically widening head section, by means of which demolding of the injection mold in the injection molding process of the insulating housing is easily and reliably possible.

By means of the head section widening conically to the outside, a surface for exerting pressure on the push button is provided, which can be reliably acted upon using commercially available screwdrivers as an actuation tool.

Starting from the spring bow in the non-actuated state in which the clamping leg is not deflected toward the contact leg by the push button, the clamping leg of the clamping spring can be aligned such with respect to the spring bow that the clamping leg extends next to the push button in the direction of extension of the push button and after a deflection, is guided through the actuation channel and the conductor insertion channel or their openings below the actuation end of the non-actuated push button in its resting position. This deflection of the clamping leg, behind which, when viewed starting from the spring bow, the clamping leg is guided under the actuation end of the push button, represents the range in which the distance between the clamping leg and the contact leg is the least. The actuation end of the push button is then aligned such to the clamping leg that the actuation end biases the section of the clamping leg located behind the deflection and upon displacement of the push button slides along said section. This way, the clamping spring is biased at a distance from the spring bow in the area of the clamping leg starting from the spring bow located behind the deflection. This ensures that the force effect of the clamping spring with respect to the sliding plane of the push button is at such an optimum angle on the insulating housing or in the direction of the actuation axis that the tilting and bending moments and deformation energy acting on the push button are kept as low as possible.

The deflection of the clamping leg may have an internal angle in the range of 90° to 160°, and preferably up to 140°. This ensures that according to the reasons mentioned above, the clamping leg is oriented at a suitable proportion to the actuation axis or to the sliding plane of the push button.

The clamping leg can form the clamping edge on the clamping leg end with its end edge. A clamping section adjoining the clamping leg end at the clamping edge can be bent pointing towards the connection opening of the bus bar. By this additional deflection of the clamping leg on the clamping leg end, it is possible to orient the section of the clamping leg acting on the actuation end of the push button at a greater angle to the actuation axis than would be possible without this angular deflection on the clamping leg.

The clamping leg of the clamping spring can be formed such that in every state of actuation, it exerts a force on the push button at an angle of less than 50° to a sliding plane, on which the push button is guided longitudinally displaceably. This ensures that tilting moments acting on the push button as well as deformation energy are kept as low as possible.

The actuation axis and the conductor insertion axis can intersect the clamping leg of the clamping spring independently of each other at different intersections and may run mutually spaced through a connection opening in the bus bar to intersect only just below the plane of the bus bar, which contains the connection opening. Thus, the push button and the conductor to be clamped are close to each other and are aligned at an angle to each other, such that the push button and the electrical conductor act on the clamping leg independently of one another, wherein upon actuation, the push button slides along the clamping leg.

In the state of actuation, the actuation end of the push button can be close to the clamping leg end or close to the clamping edge, such that the connection can be overall reduced. With regard to the fact that the actuation end slides along a fairly long path on the clamping leg, the actuation forces can be homogenized and thus overall reduced. The actuation force can thus be kept mostly constant over the entire actuation path, which leads to a consistent level of the actuation force. This also makes it possible to securely and consistently return the push button.

The push button may have a shoulder which with a projection in the actuation channel forms a return stop in the direction counter to the actuation direction of the push button. This prevents the push button from falling out of the actuation channel. During assembly, the push button is introduced in the actuation channel, wherein the side walls can widen until the return stop catches behind the recess or the latching edge of the side wall.

Between the actuation channel and the conductor insertion channel is a dividing wall. The boundary wall of the actuation channel situated opposite the dividing wall is inclined relative to the actuation axis. Thus, the inside wall of the actuation channel opposite the dividing wall is designed to be inclined towards the actuation opening of the actuation channel in the direction of the dividing wall. During the return of the push button, this leads to a tilting of the push button in the direction of the dividing wall or the conductor insertion channel, such that a slot between the dividing wall and the top end is reduced and preferably at least largely closed. The possible penetration of dirt and/or foreign particles is thus avoided, and the visual appearance is also improved.

The push buttons may have groove-like depressions. This groove-like depressions can be arranged, for example, on the lateral bearing surfaces. For different types of push buttons, different depressions can be provided. This way, it is possible to encode the push buttons for optical sensing in automated assembly.

For a generic type connecting terminal, it is further proposed that in the state of actuation, in which the clamping leg is displaced toward the contact leg by the push button, the bus bar and the push button protrude into the connection opening. The central actuation axis of the actuation channel is offset from the center axis of the connection opening in the width direction of the connection opening. An actuation head received in the actuation channel is thicker in the width direction than the section of the adjoining push button leading to the connection opening. The center of the connection opening in the plane of the bus bar thus does not align with the center of the actuation channel, so that when the push button is inserted and overall symmetrically designed, a gap is present in the actuation channel between the lateral wall of the insulating housing of the connecting terminal and the push button. In order to reduce and/or homogenize such a gap, and to simultaneously utilize the same symmetric push buttons in mirror image to each other, i.e., laterally inverted at both ends, for example, of a terminal block, the actuation head of the push button is formed slightly thicker in the width direction than in the rest of the section. This results in the actuation opening of the actuation channel being filled in as much as possible in the width direction except for a small gap. The push button is aligned slightly tilted in the actuation channel in the series-line up direction of the terminal block on a mounting rail. This embodiment, which can be combined with the above described further features of the connecting terminal, results in a balanced connection diagram on the upper side of the connecting terminal.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
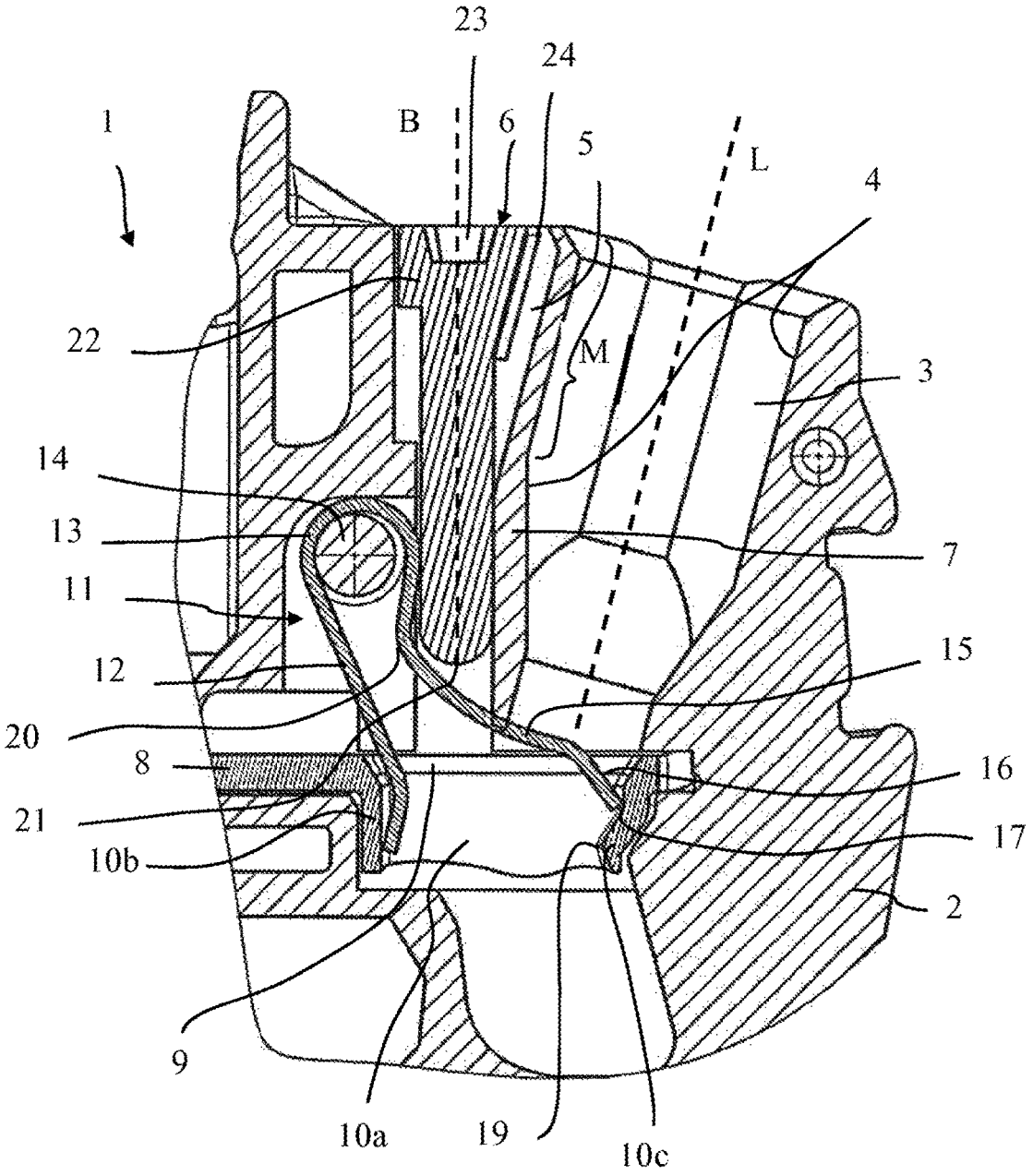
FIG. 1 is a sectional view of a connecting terminal in a non-actuated state.

FIG. 1 shows a sectional view of a connecting terminal 1 with an insulating housing 2. In the illustrated embodiment, the connecting terminal 1 is part of a terminal block, which is shown only as a cutout and can have a plurality of such connecting terminals.

The insulating housing 2 has a conductor insertion channel 3 which is delimited by circumferential conductor channel walls 4. An actuation channel 5 is arranged next to the conductor insertion channel 3 in which a push button 6 is displaceably mounted. The conductor channel wall 4 of the conductor insertion channel adjoining the actuation channel 5 forms a dividing wall 7 to the actuation channel 5.

The connecting terminal 1 further has a bus bar 8 with a connection opening 9, which is introduced into the plane which is spanned by the bus bar 8. The connection opening 9 is formed as a material passage having lateral guide walls 10*a* that project downward from the plane of the bus bar 8 in the insertion direction of an electrical conductor and are oriented in the longitudinal direction of the bus bar 8, as well as a bearing wall 10*b* and a clamping wall 10*c*. The guide walls 10*a* are integrally formed from the material of the bus bar 8 and provide guide walls for an electrical conductor.

A leg spring 11 bent in a U-shape is inserted into this connection opening 9 of the bus bar 8. The leg spring 11 has a contact leg 12 which rests against a bearing wall 10*b* projecting from the bus bar 8 and is supported there. A spring bow 13 adjoins the contact leg 12 of the leg spring 11. The leg spring is received in a free space of the insulating housing 2. The range of motion of the leg spring 11 may be limited by the wall surfaces of the insulating housing 2 restricting the free space, and optionally by an additional holding pin 14.

A clamping leg 15 diametrically opposed to the contact leg 12 adjoins the spring bow 13. This clamping leg 15 dives with its free connecting terminal end into the connection opening 9. The clamping leg 15 forms a clamping edge 17 on the clamping leg end 16 with its end edge. An electrical conductor introduced in the conductor insertion channel 3 can then be clamped between the clamping edge 17 and the bus bar 8. For this purpose, the bus bar 8 provides a clamping wall 10*c* which is integrally formed from the material of the bus bar 8 and extends obliquely to the plane of the bus bar 8 into the alignment of the connection opening 9. This clamping wall 10*c* is formed by a bending contour such that a projecting contact edge 19 is provided and, in the illustrated state of rest, the clamping edge 17 abuts the connection opening 9 of the clamping wall 18 without the conductor being inserted.

In the vicinity of the spring bow 13, the clamping leg 15 has a deflection 20 and is guided such that in the illustrated non-actuated state in which the clamping leg 15 is not deflected by the push button 6, the clamping leg 15 extends starting from the spring bow 13, initially in the direction of extension of the push button 6 next to the push button 6 and at the deflection 20 ultimately below the actuation end 21 of the push button 6. The clamping leg 15 is transversely guided in this way through the actuation channel 5 and the conductor insertion channel 3, i.e., through the mouths thereof. "Transverse" is understood to mean that the clamping leg 15 intersects with the actuation channel 5 and the conductor insertion channel 3 at an angle of more than 45° and is thus aligned substantially perpendicular thereto.

The clamping leg 15 is further formed with its deflection 20 such that the distance between clamping leg 15 and contact leg 12 is the smallest at the deflection.

Furthermore, it is clear that in the non-actuated state the dividing wall 7 is formed down to the clamping leg 15. The dividing wall 7 does not have to touch the clamping leg 15, but instead can adjoin it at a distance of a small gap. However, this distance should be as small as possible and preferably less than the thickness of the clamping leg 15 as a threshold for tolerance. It is thus achieved that also in the vicinity of the clamping spring 11, the push button 6 is guided in a region in which the force action by the clamping spring 11 on the push button 6 and thus on the adjoining dividing wall 7 is the greatest.

It is further evident that in the area of the conductor insertion channel 3 leading outward, a cylindrical sheath receiving section M is created by the circumferential conductor channel walls 4. This sheath receiving section M can also be oval or polygonal. It is only essential that in the area of the sheath receiving section M, the diameter or the cross sectional area over the conductor insertion axis L is constant. The conductor insertion axis L is determined by the direction of extension of the conductor insertion channel 3 and thus by the conductor channel walls 4 centrally extending thereto.

A section conically tapering toward the bus bar 8 adjoins the sheath receiving section M. In this conically tapering region of the conductor insertion channel 3, the dividing wall 7 serving as a partition to the actuation channel 5 extends in the direction of the actuation axis B and is aligned in parallel with said actuation axis B. The actuation axis B is determined by the direction of extension of the push button 6 and by the shape of the interior walls of the actuation channel 5 adapted thereto, which run concentrically around the actuation axis B.

It is clear that the actuation axis B is aligned at an angle to the conductor insertion axis L. The angle between the actuation axis B and the conductor insertion axis L is in the range of 5° to 20°. In the illustrated embodiment, it is approximately 15°+/−5°.

It is also clear that the actuation axis B is aligned approximately perpendicular to the plane of the bus bar 8 and thus to the plane which is spanned by the connection opening 9. The conductor insertion axis L is at an inner angle of about 75° to the plane of the bus bar 8.

It can also be seen that in a head section, which is adjacent to the cylindrical sheath section M, the actuation channel 5 is widened conically towards the outside of the insulating housing 2. In this conically widening head section of the actuation channel 5, the actuation head 22 of the push button 6 increases in thickness towards the top end when viewed in cross section from the conductor insertion channel 3 to the clamping spring, i.e., in the illustrated section.

At the top end of the push button 6 there is an actuation slot 23 or other recess, which is provided for receiving the end of an actuation tool.

The dividing wall 7 between the conductor insertion channel 3 and the actuation channel 5 has a lobe 24 at its outer end. The latter is formed by elastic deformation after demolding an injection molding tool part from the conductor insertion channel 3 and the actuation channel 5.

Figure 2:
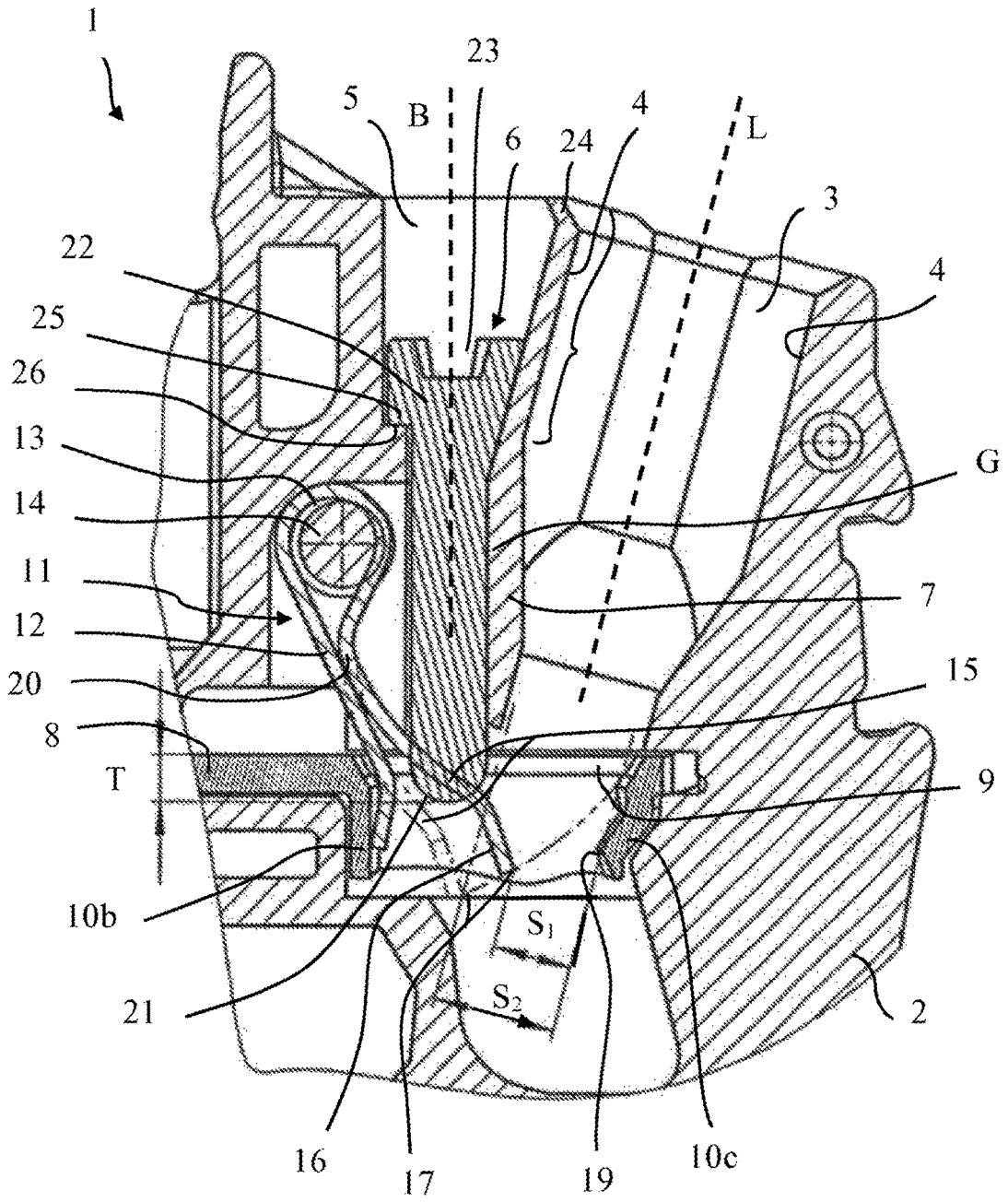
FIG. 2 is a sectional view of the connecting terminal of FIG. 1 in an actuated state.

FIG. 2 shows the connecting terminal 1 of FIG. 1 in the now actuated state. It is evident that now, the push button 6 is shifted linearly in the actuation channel 5 in the direction of the actuation axis B down toward the bus bar 8. In this case, the push button 6 is guided along a sliding plane G formed by the dividing wall 7 in the direction of the actuation axis B. When the push button 6 is actuated, i.e., when it is pressed downward in the direction of the bus bar 8, the clamping leg 15 of the clamping spring 11 exerts a force on the push button 6. The force direction is always less than 50° to the sliding plane G and thus directed substantially in the direction of the actuation axis B. The influence of shear forces which act on the push button 6 is thus considerably reduced. In addition, the dividing wall 7 that is drawn very far down to the bus bar 8 can absorb such shear forces and the resulting tilting moments. In every state of actuation, the forces acting on the clamping spring 11 by the push button 6 are directed toward the dividing wall 7 and not toward areas of the push button 6 not supported by the insulating housing 2.

The clamping leg 15 is shown in two deflection states. In the upper state overlapping the push button 6, the push button 6 would not dip into the connection opening 9 of the bus bar 8. In this case, the mating dimension $S_1$ for clamping an electrical conductor would be much lower than the smallest diameter of the conically tapering conductor insertion channel 3. An electrical conductor would then encounter the connecting terminal end 16 and be guided by the latter into this bottleneck.

The actual deflection state of the clamping leg 15 is the one deflected further having the mating dimension $S_2$. It becomes apparent that here, a mating dimension is achieved that almost corresponds to the entire smallest diameter of the conically tapering conductor insertion channel 3. In this state, the push button 6 dips with its actuation end 21 into the connection opening 9 of the bus bar 8 with a depth T. This depth T is greater than the thickness of the bus bar 8 in the area adjoining the connection opening 9. It becomes evident that an electrical conductor guided by the dividing wall 7, which is inserted into the conductor insertion channel 3, is subsequently first guided through the actuation end 21 of the push button 6 to then first reach the clamping edge 17. The actuation end 21 of the push button 6 thus lies between the free end of the dividing wall 7 facing the inside of the connecting terminal and the clamping leg end 16. The clamping edge 17 of the clamping leg 15 is thus recessed from the actuation end 21 of the push button 6.

It is also clear that the smallest distance of the clamping leg 15 to the contact leg 12, even in the state of actuation, is also present at least in the area of the deflection 20.

When the push button 6 is actuated, the actuation end 21 slides downward along the clamping leg 15 toward the further deflection to the clamping leg end 16 in the area adjoining the deflection 20. Thus, a relatively long sliding path along the clamping leg 15 is utilized. This embodiment, in conjunction with the dividing wall 7 pulled down to the area adjacent to the bus bar 8 and the push button 6 which extends without projection towards the actuation axis B and is active in the alignment of the actuation axis 8 with its actuation end 21, ensures that the deformation forces on the push button 6 are minimal. In addition, the interaction between push button 6 and clamping spring 11 is optimal due to the long actuation stroke. The small space available in the connection opening 9 for clamping the electrical conductor and for receiving the clamping spring 11 may continue to be utilized to accommodate the push button 6 by the angular offset of actuation axis B and conductor insertion axis L. This way, it is possible in the completely actuated state to act on the clamping spring 11 at a point as far away from the spring bow 13 as possible, thereby optimizing the force effects.

It also becomes clear that in the completely actuated, pushed-down state, the actuation head 22 conically widening towards the outside has adapted to the head portion of the actuation channel 5, which conically widens towards the outside of the insulating housing 2. In this case, an optional step 25 at the head portion together with a step 26 in the actuation channel 5 can form a stop, by means of which the displacement of the push button 6 to the bus bar 8 is delimited.

Figure 3:
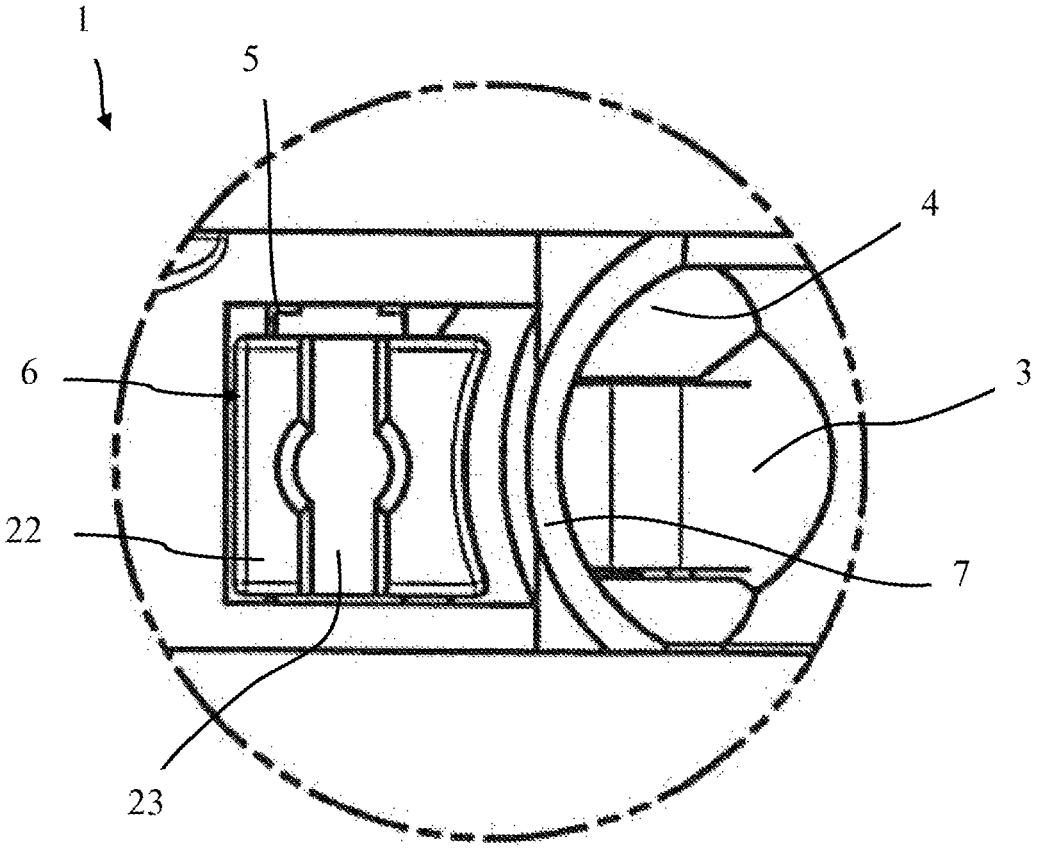
FIG. 3 shows a detail of the connecting terminal of FIG. 1 in a plan view.

FIG. 3 displays a plan view of a section of the connecting terminal 1 from FIG. 1 in the non-actuated state. It is evident that the head portion 22 has an actuation slot 23. This can also be a different shape, such as cross-shaped, square or round.

It is also clear that the dividing wall 7 forming a conductor channel wall 4 is curved between the conductor insertion channel 3 and the actuation channel 5 when viewed in the cross section of the conductor insertion channel 3. The actuation head 22 has a curved contour adapted thereto. This also applies to the section of the push button 6 adjoining the actuation head 22 and leading towards the actuation end 21, which thus has a constant cross section over its length.

Figure 4:
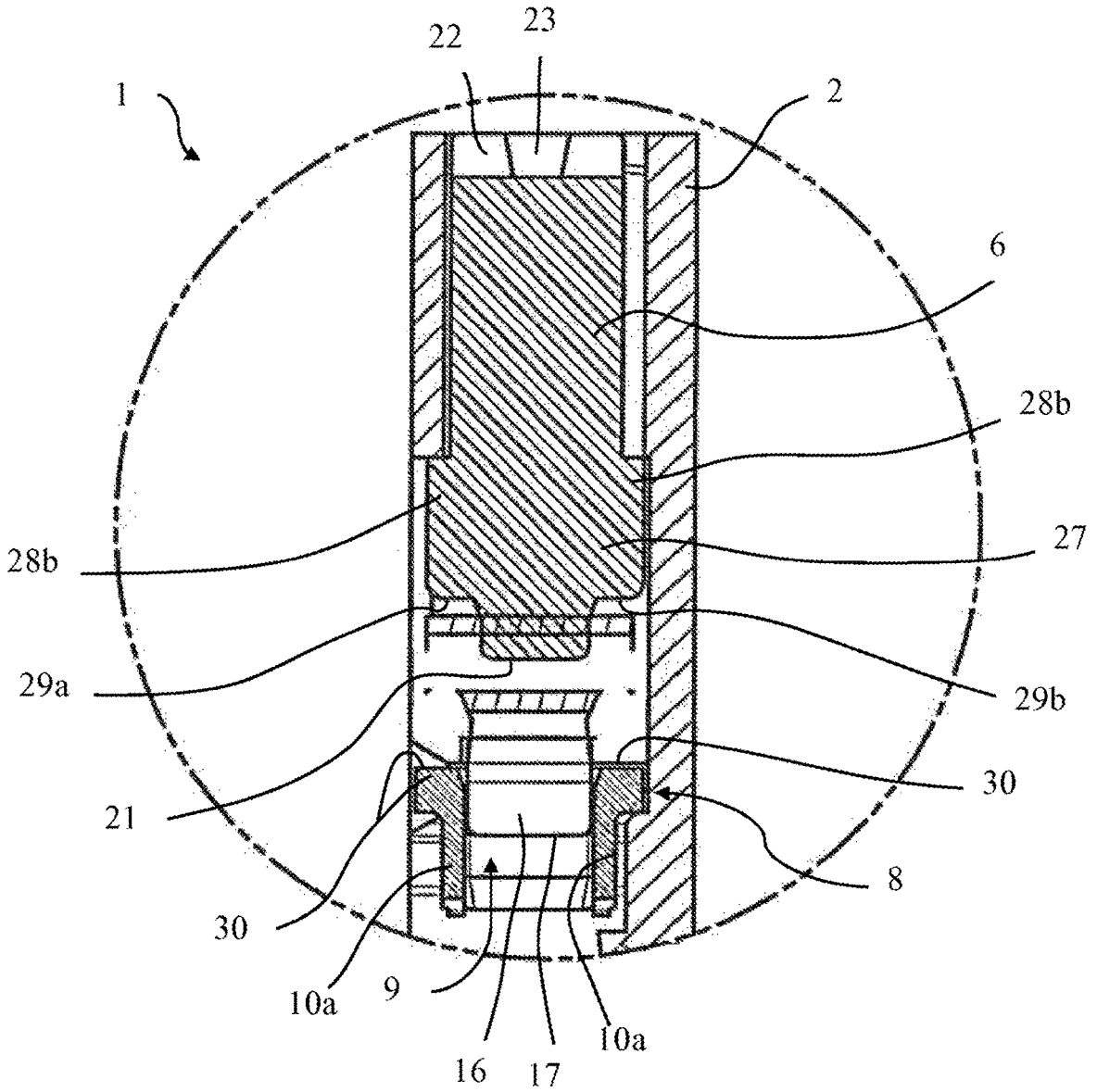
FIG. 4 is a cross sectional view of a detail of the connecting terminal of FIG. 1 in the non-actuated state.

FIG. 4 shows a cross sectional view of the connecting terminal 1 of FIG. 1 in the non-actuated state as a cutout. In this case, it is evident that in the region of the actuation head 22 in the detail in the width direction of the bus bar 8, the push button 6 has a smaller width than in a central portion 27 adjoining thereto and leading towards the bus bar 8. In this central portion 27, bearing surfaces 28*a*, 28*b* laterally project from the contour of the push button 6, which are supported on guide wall surfaces of the insulating housing 2. These are supported in an area of the insulating housing 2 which is not weakened as much by the adjacent conductor insertion channel 3 as the section of the intermediate dividing wall 7 situated in the center region.

It can also be seen that at its actuation end 21 acting on the clamping leg 15, the push button 6 has a shoulder 29*a*, 29*b* which decreases to the width of the actuation end 21 as compared to the central portion 27 and the actuation head 22. This shoulder 29*a*, 29*b* forms a stop for bearing on an edge portion 30 of the bus bar 8 delimiting the connection opening 9.

The width of the actuation portion 21 seen in the illustrated cross section is adapted to the width of the connection opening 9 in the bus bar 8 and at least slightly less than said width of the connection opening 9. In this way, it is ensured that the push button 6 can dip into the connection opening 9.

Figure 5:
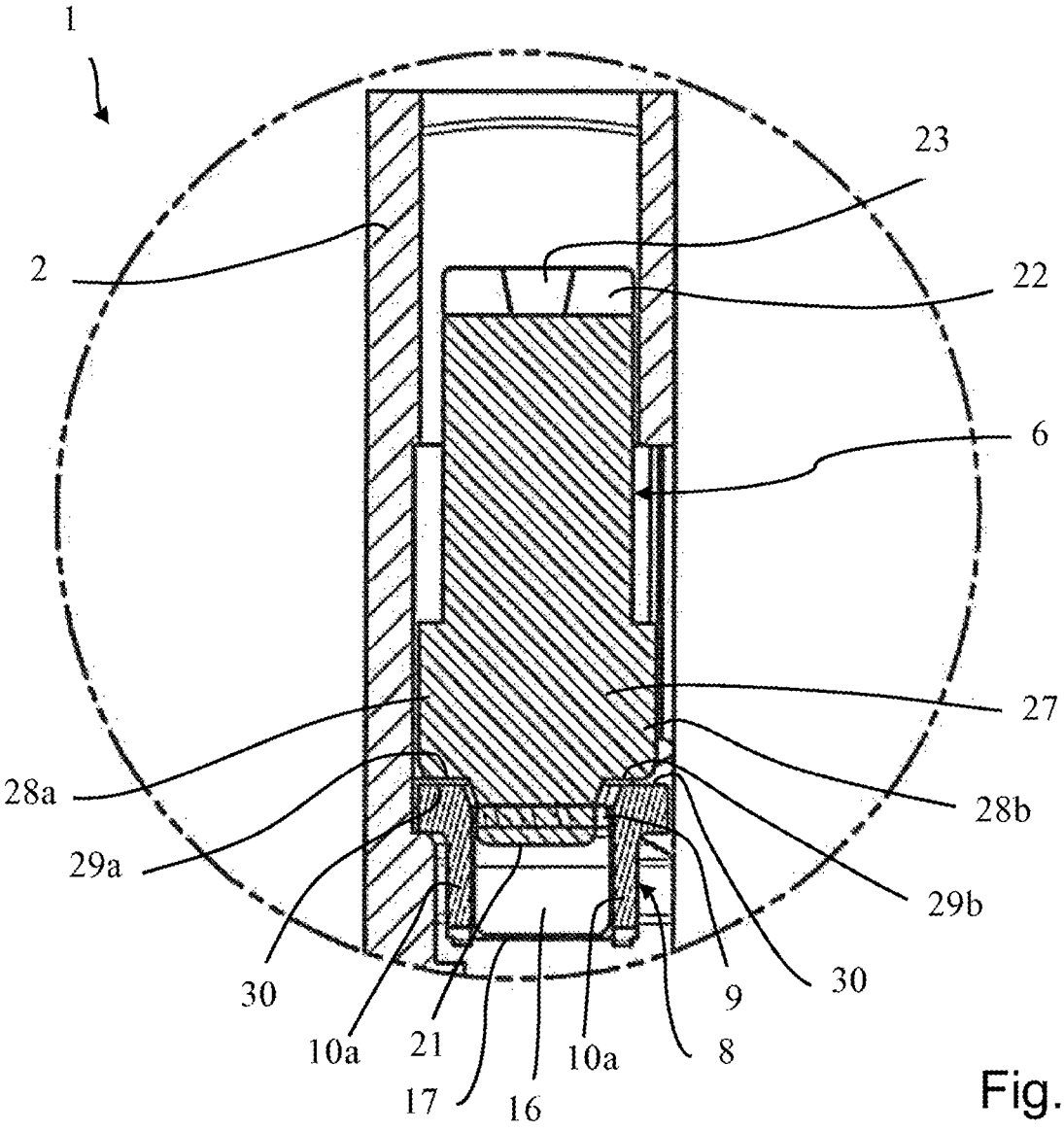
FIG. 5 is a cross sectional view of a detail of the connecting terminal of FIG. 2 in the state of actuation.

FIG. 5 shows a cross sectional view of the connecting terminal 1 of FIG. 2 in the state of actuation. It becomes clear that the actuation end 21 dips into the connection opening 9 of the bus bar 8. The shoulders 29*a*, 29*b* formed towards the actuation end 21 in the transition of the widened lateral bearing surfaces 28*a*, 28*b* of the central portion 27 thereby abut the edge portions 30 of the bus bar 8, which laterally delimit the connection opening 9. This way, the push button 6 is prevented from further depressing into the connection opening 9.

FIGS. 4 and 5 further clarify that the center of the connection opening 90 does not align with the center of the actuation channel 5. In the inserted, overall symmetrically designed push button 6, a gap is present in the actuation channel 5 between the lateral wall of the insulating housing 2 of the connecting terminal 1 and the push button 6.

Figure 6:
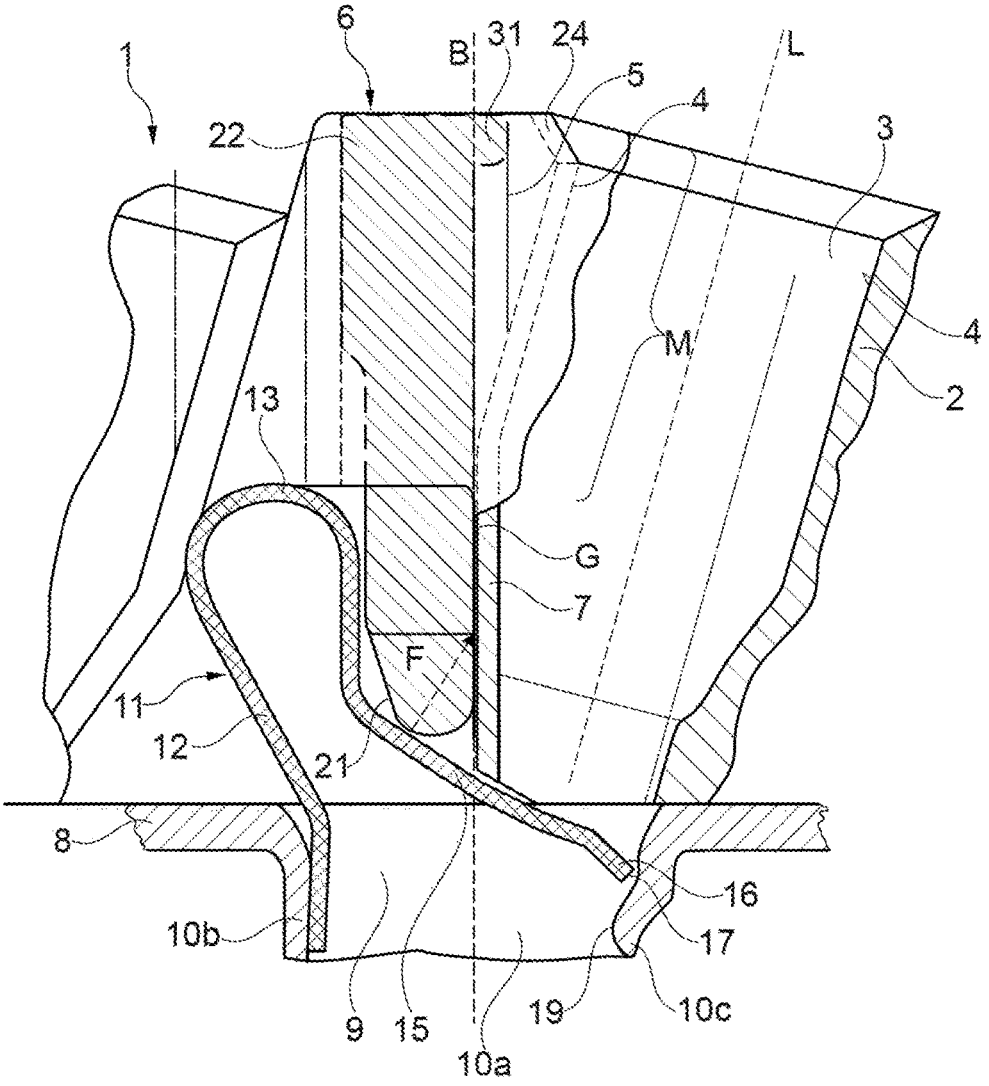
FIG. 6 is a sectional view of another connecting terminal in the non-actuated state.

FIG. 6 shows a sectional view of a further embodiment of a connecting terminal 1. This is similar in structure to the previously described connecting terminal 1 and in this respect only has a few modifications. In essence, therefore, reference may be made to the previous, detailed description.

It is clear that here, too, the conductor insertion channel 3 first has a cylindrical sheath section M, which then transitions into a conically tapered section. The dividing wall 7 in this region which tapers conically forms a support and sliding surface G for the push button 6. The sliding surface G is aligned in parallel with the actuation axis B. Here, too, the dividing wall 7 is drawn down so far from the upper plane of the bus bar 8 or from the plane which is spanned by the connection opening 9 that in the non-actuated state, the clamping leg 15 is spaced immediately adjacent to the dividing wall 7, where appropriate, with a small gap.

In this embodiment, the actuation head 22 has a lug 31 projecting in the direction of the conductor insertion channel 3, which in the non-actuated state protrudes freely into the conically widening head portion of the actuation channel 5.

In the region adjacent to the clamping spring 11, the push button 6 is designed free of projections and tapers up to the actuation end 21. The clamping leg 15 exerts an actuation force F on the clamping end 21 of the push button 6, which, as shown, is aligned at an acute angle to the sliding plane G or the actuation axis B. This acute angle amounts to less than 50°. In the illustrated non-actuated state, the internal angle of the direction of force F to the sliding plane G amounts to about 30°.

In this exemplary embodiment also, the actuation axis B is arranged offset at an angle to the conductor insertion axis L. Here, too, this angle is about 15°+/−5°.

Very suitable is an angle of 16°, wherein the actuation axis B is perpendicular to the plane of the bus bar 8 or to the plane spanned by means of the connection opening 9 in the bus bar 8.

Figure 7:
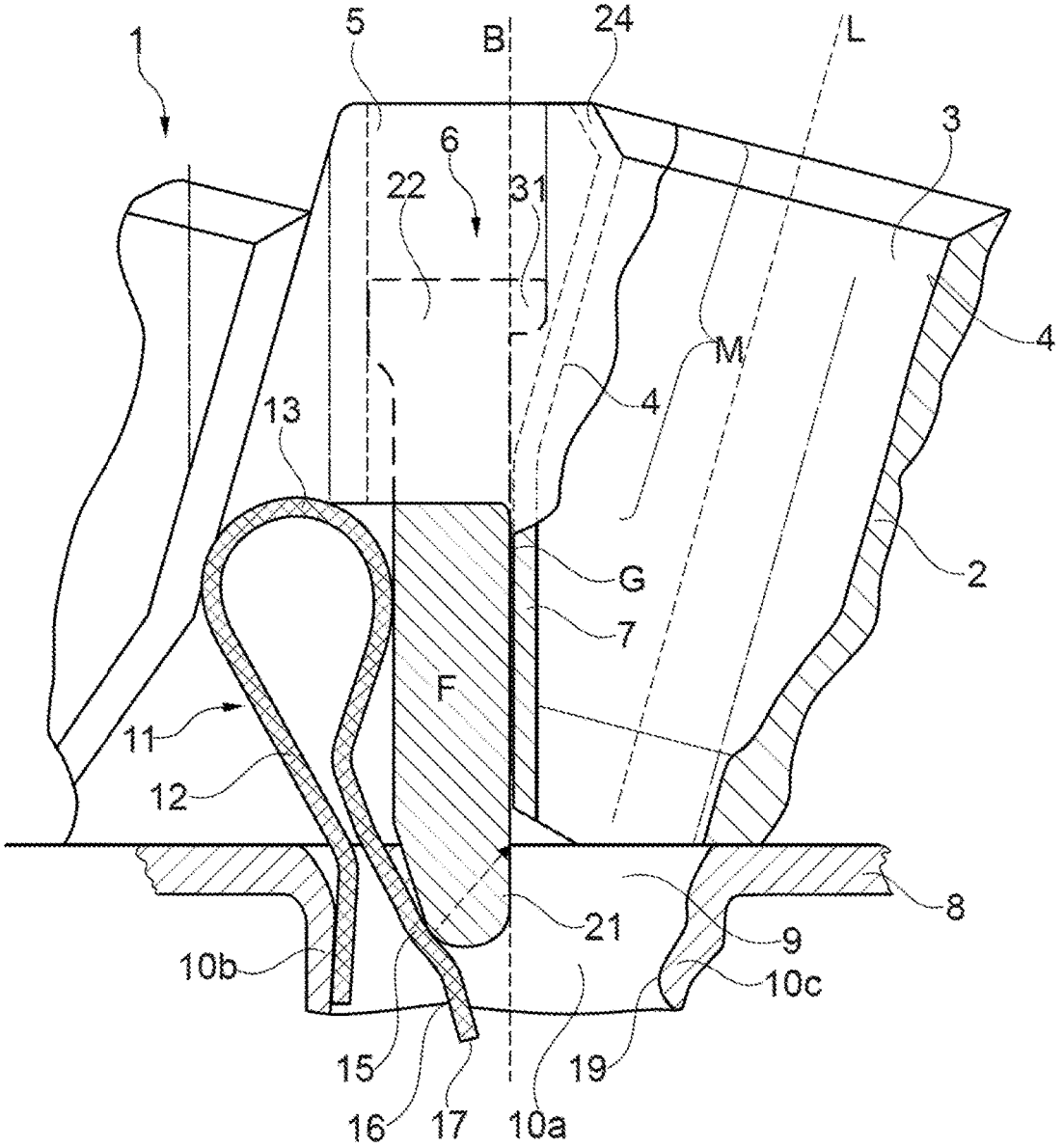
FIG. 7 shows a connecting terminal of FIG. 6 in the state of actuation.

FIG. 7 shows the connecting terminal of FIG. 6 in the state of actuation. In this case, the push button 6 is linearly displaced in the direction of the actuation axis B and along the sliding plane G in the image plane downward towards the bus bar such that the tapering actuation end 21 dips into the connection opening 9 of the bus bar 8. In this case, the clamping leg 15 of the clamping spring 11 exerts an actuation force F on the actuation end 21, which acts at an angle of less than 50° towards the sliding plane G. Again, the inner angle is considered. The force acting on the push button 6 by the clamping leg 5 is thus directed in the direction of the actuation axis B rather than transversely thereto. The force direction is oriented such that it points toward the dividing wall 7. The tilting moments acting on the actuation end 21 are thus negligible. Due to the tapering actuation end 21, which follows the direction of extension of the sliding plane G and the actuation axis B and is free of projections, such adverse tilting moments and deformation energies are avoided, which could affect the stability of the push button 6.

In both exemplary embodiments, it is clear that the conductor channel wall 4 opposite the dividing wall 7 is initially guided beyond the sheath receiving section M without an inclined surface. The inclined surface adjoining there, which leads to the conical tapering of the conductor insertion channel 3, is situated below the sheath receiving section M when viewed in the conductor insertion direction towards the bus bar 8.

Whereas the dividing wall 7 extends in a straight line to the actuation channel 5 below the sheath receiving section M, on the opposite side after a first inclined surface, the conductor channel wall 4 has a further end portion which follows substantially the direction of extension of the conductor channel wall 4 in the sheath receiving section M. This end portion then merges into the transition of the connection opening 9 for connecting the bus bar 8 and serves therefore as an extension of the clamping wall 10*c*.

In the first exemplary embodiment, on the other hand, the dividing wall 7 is rectilinear towards the bus bar 8 towards the actuation opening in the area of the guide section for the push button 6. However, the dividing wall 7 has a nonuniform cross section in this guide section and forms a wall section below the sheath section M, which conically tapers the conductor insertion channel 3. Adjoining this conical tapering of the conductor insertion channel 3, in the mouth towards the connection opening 9 in the bus bar 8, the end portion of the conductor insertion channel 3 merges into a cylindrical section or a section with a constant cross section.

Figure 8:
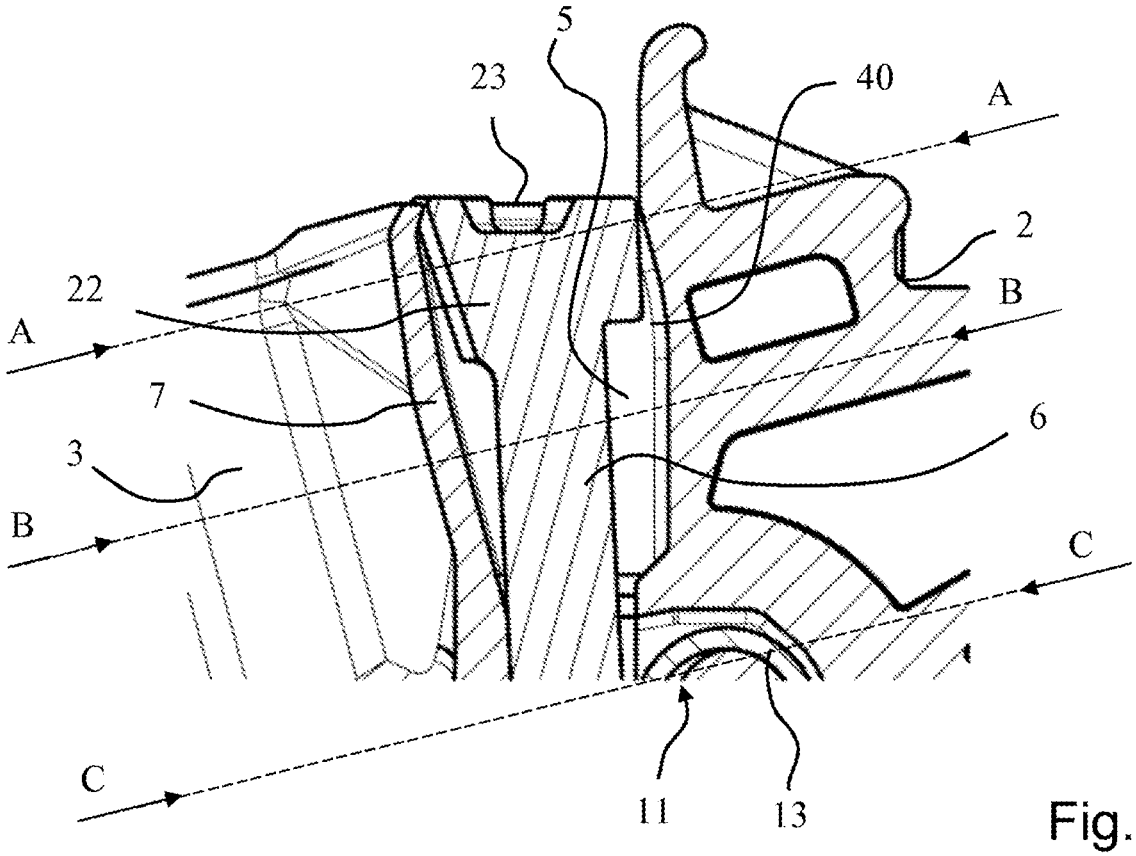
FIG. 8 is a cross sectional view of a detail of an embodiment of the connecting terminal.

FIG. 8 shows a cross sectional view of a detail of an embodiment of the connecting terminal 1 in the area of the actuation head 22 of the push button 22. It is clear that the inside wall 40 of the actuation channel 5 toward the actuation opening situated opposite the dividing wall 7 is formed inclined at the top end of the actuation channel 5 in the direction of the dividing wall 7. In the illustrated return of the push button 6, this leads to a tilting of the push button 6 in the direction of the dividing wall 7 and the conductor insertion channel 3. Thus, the gap or slot seen in FIGS. 3 and 4 is at least largely closed between the dividing wall 7 and the actuation head 22. The possible penetration of dirt and/or foreign particles is thus avoided, and the visual appearance is improved.

It is clear that the actuation head 22 is somewhat thicker in the width direction than over the remaining portion. Thus, the actuation opening of the actuation channel 5 in the width direction can be filled out as much as possible except for a small lateral gap. In the actuation channel 5, the push button 6 is aligned slightly tilted in the series-line up direction of the terminal block on a mounting rail, i.e., in the direction of the side walls. Thus, at both ends of a terminal block, in each case the same symmetrical push button 6 can be used reversibly, and a uniform connection diagram is achieved.

Figure 9:
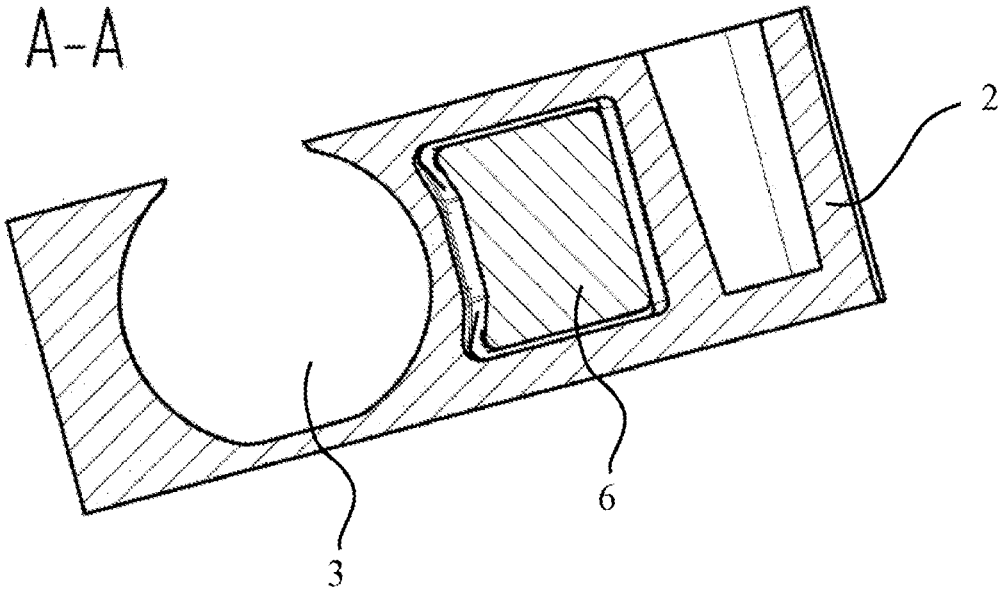
FIG. 9 is a cross sectional view of the detail of FIG. 8 in section A-A.

FIG. 9 shows a cross sectional view of the detail of FIG. 8 in section A-A. It can be seen that the actuation head 22 fills the actuation channel down to a small remaining gap. It is also clear that a side wall of the conductor insertion channel is opened laterally. In this area, an insulating sheath of an electrical conductor to be clamped can be dipped, which assumes the insulating function of the side wall. In this way, the connecting terminal, for example in the form of a terminal block, can be made narrower.

Figure 10:
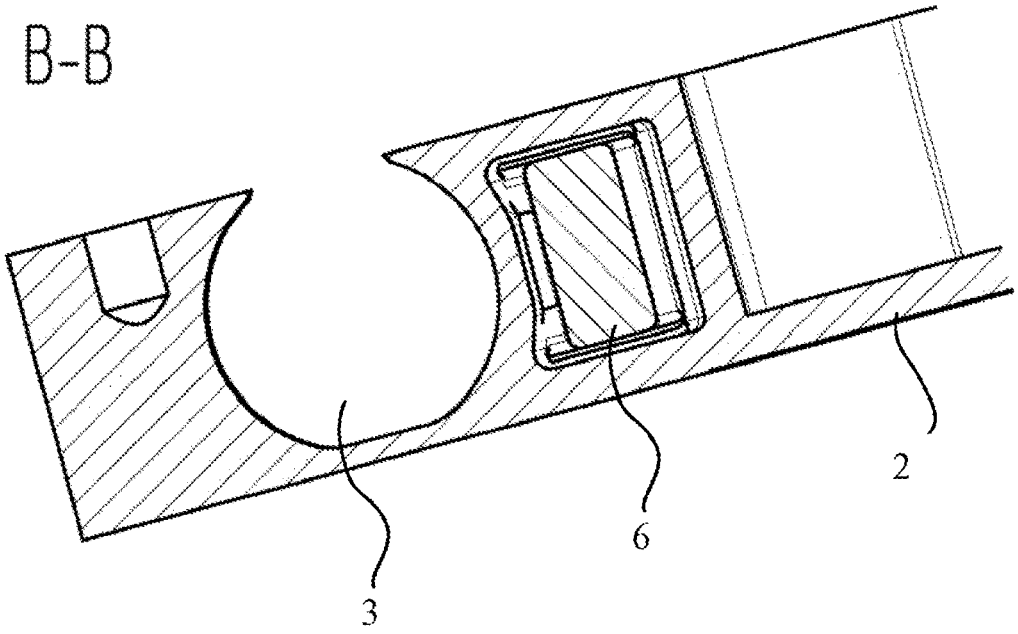
FIG. 10 is a cross sectional view of the detail of FIG. 8 in section B-B.

FIG. 10 shows a cross sectional view of the detail of FIG. 8 in section B-B. It is clear that the push button 6 is markedly narrower in this section than in the area of the actuation head 22. The conductor insertion opening 3 is also laterally opened in this area and is circumferentially closed only with the insulating sheath of the electrical conductor to be clamped or with the side wall of an adjacently arranged terminal block.

Figure 11:
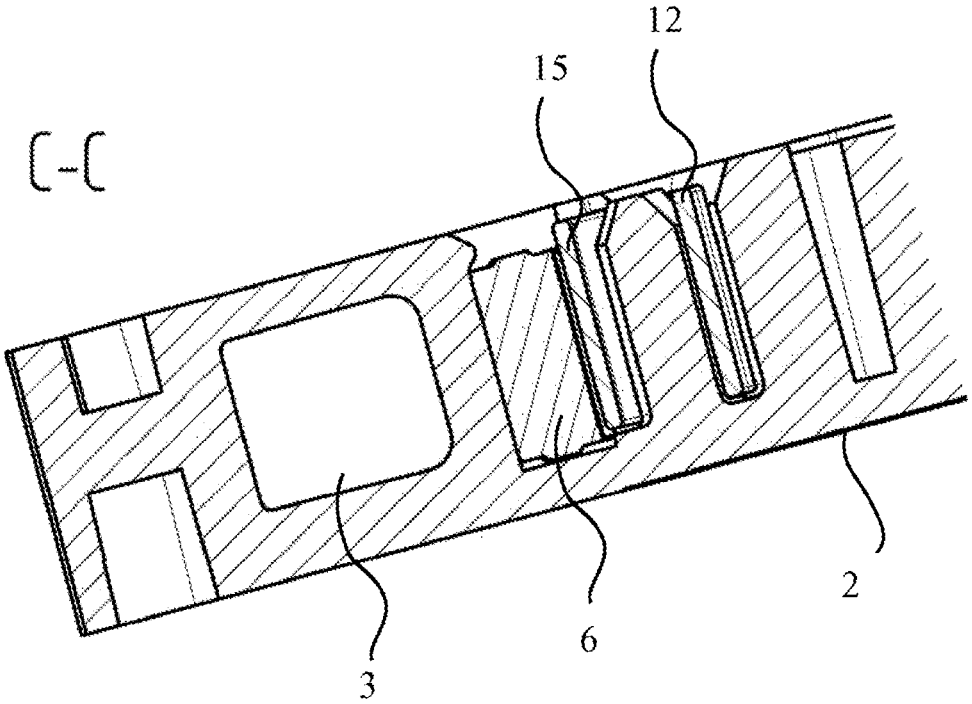
FIG. 11 is a cross sectional view of the detail of FIG. 8 in section C-C.

FIG. 11 shows a cross sectional view of the detail from FIG. 8 in section C-C. In this portion of the section, the push button 6 is located on the clamping leg 15 of the clamping spring so it can slide down along the clamping leg 15 towards the clamping edge when depressed. The conductor insertion opening 3 is tapered in this portion of the section and circumferentially closed by the insulating housing 2. In this part of the section, the stripped end of an electrical conductor to be clamped is received.

Figure 12:
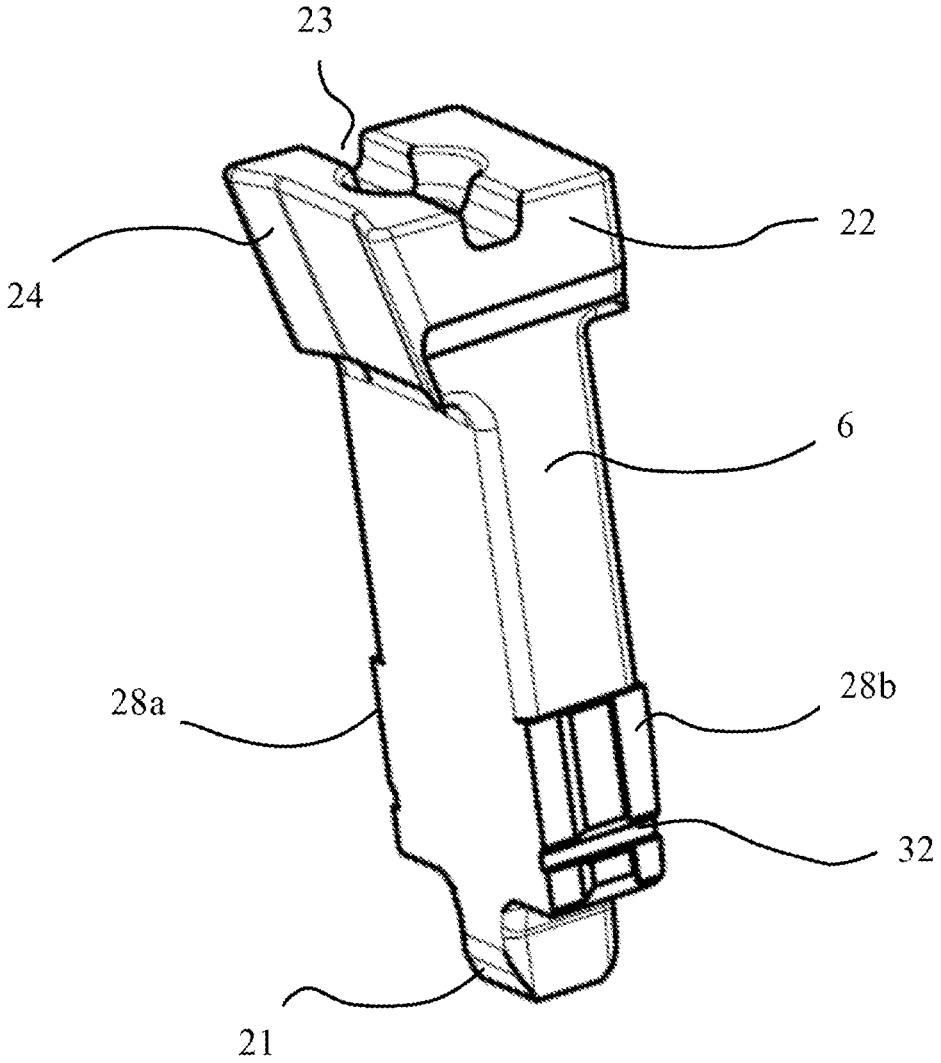
FIG. 12 is a perspective view of the front of the push button of the connecting terminal of FIG. 7.
Figure 13:
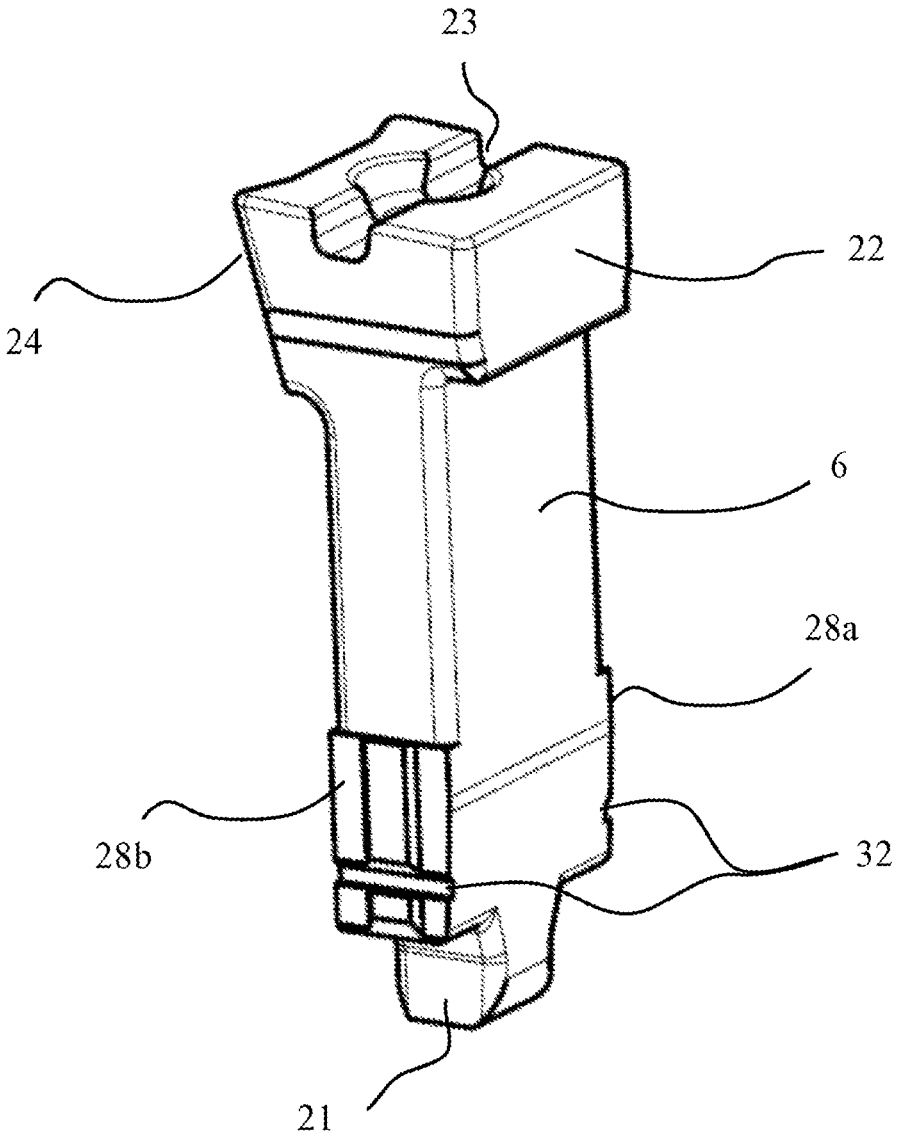
FIG. 13 is a perspective view of the rear of the push button of the connecting terminal of FIG. 7.

FIGS. 12 and 13 show a perspective view of the front side and back side of the push button of the connecting terminal of FIG. 7. It can be seen that the push button 6 is widened in the area of the lateral bearing surfaces 28*a*, 28*b*. At least in the state of actuation of the push button 6, this width protrudes beyond the width or the diameter of the conductor insertion channel 3, so that the acting spring forces can be absorbed by the thicker lateral sidewalls. This is indicated in FIG. 11. The dividing wall 7 can thereby be made thinner in the center area, which results in an overall smaller design of the connecting terminal.

It can also be seen that the push button 6 has groove-like recesses 32 in the area of the bearing surfaces 28*a*, 28*b*. These can be different for different variants of the push button 6. The groove-like recesses 32 are thus encodings that can be detected using automated optical sensing and can be used for an automated assembly.

Figure 14:
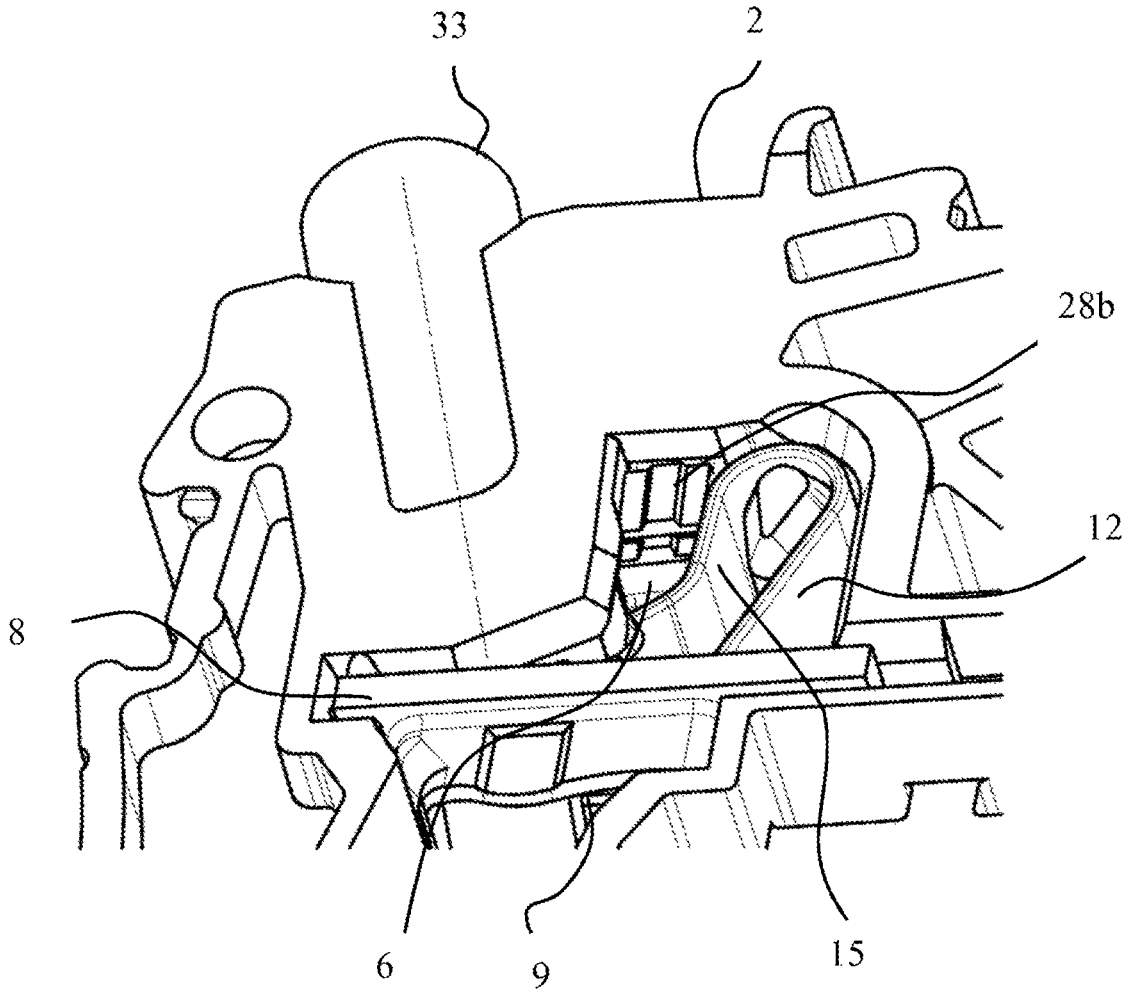
FIG. 14 is a perspective view of the connecting terminal of FIG. 8, obliquely from below.

FIG. 14 shows a perspective view of the connecting terminal 1 from FIG. 8 obliquely from below. It is clear that the laterally opened side wall of the conductor insertion channel 3 is filled out by the insulating sheath of an electrical conductor 33 to be clamped. It can further be seen that the push button rests on the clamping leg 15 of the clamping spring 11. The bearing surfaces protrude laterally and are applied to the insulating housing 2.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connecting terminal comprising:

an insulating housing having a conductor insertion channel extending in a direction of a conductor insertion axis with an at least partially circumferential conductor channel wall disposed coaxially to the conductor insertion axis and an actuation channel arranged adjacent to the conductor insertion channel;

a leg spring bent in a U-shape, the leg spring having a contact leg, a clamping leg and a spring bow connecting the contact leg to the clamping leg;

a bus bar; and a push button received in the actuation channel in a longitudinally displaceable manner, wherein the contact leg is mounted on the bus bar and a clamping edge of the clamping leg forms a spring clamp connection with a contact region of the bus bar for clamping an electrical conductor inserted into the conductor insertion channel, and wherein an actuation axis, defined by the longitudinal displacement direction of the push button in the actuation channel, and the conductor insertion axis are aligned with each other at an angle of 5° to 30°.

2. The connecting terminal according to claim 1, wherein the actuation axis and the conductor insertion axis are aligned to each other at an angle of 5° to 20°.

3. The connecting terminal according to claim 1, wherein the insertion channel wall forms a dividing wall to the actuation channel and the push button is guided in a section of the dividing wall, which conically tapers the conductor insertion channel.

4. The connecting terminal according to claim 1, wherein the bus bar has a connection opening and the leg spring is inserted into the connection opening, wherein in a state of actuation in which the clamping leg is displaced towards the contact leg via the push button, the push button projects into the connection opening.

5. The connecting terminal according to claim 4, wherein on an actuation end acting on the clamping leg, the push button has a shoulder that reduces a width of the actuation end, and wherein the shoulder forms a stop for an abutment on an edge region of the bus bar that delimits the connection opening.

6. The connecting terminal according to claim 1, wherein a surface of the push button facing the clamping leg and starting from an actuation head up to the clamping leg is formed free of projections.

7. The connecting terminal according to claim 1, wherein an end face of an actuation end of the push button acting on the clamping leg has a rounded contour.

8. The connecting terminal according to claim 1, wherein, in a head section situated next to a cylindrical sheath receiving section of the conductor insertion channel, the actuation channel conically widens towards an outside of the insulating housing.

9. The connecting terminal according to claim 8, wherein the push button has an actuation head in the conically widening head portion, wherein the actuation head when viewed in cross section perpendicular to the actuation axis has an increasing thickness to the outside of the insulating housing.

10. The connecting terminal according to claim 1, wherein, starting from the spring bow in a non-actuated state in which the clamping leg is not deflected by the push button towards the contact leg, the clamping leg extends in a direction of extension of the push button adjacent to the push button, and after a deflection below the actuation end of the non-actuated push button, is guided through the actuation channel and the conductor insertion channel or their mouths in its rest position, wherein a distance between the clamping leg and the contact leg is smallest at the deflection, and the actuation end biases the section of the clamping leg situated behind the deflection when viewed from the spring bow and slides along the section upon displacement of the push button in the actuation channel.

11. The connecting terminal according to claim 10, wherein the deflection is at an internal angle in the range of 90° to 160°.

12. The connecting terminal according to claim 1, wherein the clamping leg with its front edge forms the clamping edge on the clamping leg end, wherein a clamping section comprising the clamping edge end with the clamping edge is bent pointing towards the connection opening of the bus bar.

13. The connecting terminal according to claim 1, wherein in each state of actuation, the clamping leg exerts a force on the push button at an angle of less than 50° to a sliding plane, at which the push button is guided longitudinally displaceably.

14. The connecting terminal according to claim 1, wherein the actuation axis and the conductor insertion axis independently intersect the clamping leg of the clamping spring at different intersections and pass through a connection opening in the bus bar spaced from each other and intersect below the level of the bus bar, which comprises the connection opening.

15. The connecting terminal according to claim 1, wherein the push button has a shoulder, which forms a return stop with a projection in the actuation channel counter to the actuation direction of the push button.

16. The connecting terminal according to claim 1, wherein there is a dividing wall between the actuation channel and the conductor insertion channel and wherein a boundary wall of the actuation channel opposite the dividing wall is inclined relative to the actuation axis.

17. The connecting terminal according to claim 1, wherein the push button has groove-like recesses.

18. A connecting terminal comprising:

an insulating housing comprising a conductor insertion channel extending toward a conductor insertion axis with an at least partially circumferential conductor channel wall arranged coaxially to the conductor insertion axis, and an actuation channel disposed next to the conductor insertion channel;

a leg spring bent in a U-shape, the leg spring having a contact leg, a clamping leg, and a spring bow connecting the contact leg to the clamping leg;

a bus bar with a connection opening; and a push button received in the actuation channel in a longitudinally displaceable manner, wherein the leg spring is inserted in the connection opening, the contact leg is mounted on the bus bar and a clamping edge of the clamping leg forms a spring clamp connection with a contact region of the bus bar for clamping an electrical conductor inserted in the conductor insertion channel, wherein, in a state of actuation in which the clamping leg is displaced towards the contact leg via the push button, the bus bar and the push button project into the connection opening and that a center actuation axis of the actuation channel is offset toward the center axis of the connection opening in a width direction of the connection opening and an actuation head received in the actuation channel is thicker in the width direction than an adjoining section of the push button leading towards the connection opening.

19. The connecting terminal according to claim 18, wherein the push button is aligned tilted to the opening plane of the connection opening in the actuation channel from the actuation head towards the actuation end when viewed in cross section in the width direction of the connection opening.

20. The connecting terminal according to claim 18, wherein the actuation axis is aligned approximately perpendicular to a plane spanned by the connection opening.

21. The connecting terminal according to claim 18, wherein the conductor channel wall forms a dividing wall to the actuation channel and wherein the push button is guided in a section of the dividing wall that is tapered conically in a direction of the conductor insertion channel and is aligned in parallel with the actuation axis.

* * * * *